US005525638A

United States Patent [19]

Sen et al.

[11] Patent Number: 5,525,638

[45] Date of Patent: Jun. 11, 1996

[54] PROCESS FOR THE PREPARATION OF POLYBENZAZOLE FILAMENTS AND FIBERS

[75] Inventors: Ashish Sen, Midland, Mich.; Yoshihiko Teramoto, Ohtsu, Japan

[73] Assignee: The Dow Chemical Company, Midland, Mich.

[21] Appl. No.: 500,651

[22] Filed: Jul. 12, 1995

Related U.S. Application Data

[63] Continuation-in-part of Ser. No. 316,266, Sep. 30, 1994, abandoned.

[51] Int. Cl.[6] ..... C08F 6/00; C08J 9/26; C08J 9/28

[52] U.S. Cl. ..... 521/61; 521/64; 528/487; 528/499

[58] Field of Search ..... 521/61, 64; 528/487, 528/499

[56] References Cited

U.S. PATENT DOCUMENTS

| | | | |
|---|---|---|---|
| 3,767,756 | 10/1973 | Blades | 264/184 |
| 4,985,193 | 1/1991 | Allen | 264/184 |
| 5,034,250 | 7/1992 | Guertin | 427/394 |
| 5,216,114 | 6/1993 | Walles | 521/487 |
| 5,273,703 | 12/1993 | Alexander et al. | 264/184 |
| 5,286,833 | 2/1994 | Bubeck et al. | 528/183 |
| 5,288,445 | 2/1994 | Tani et al. | 264/85 |
| 5,288,452 | 2/1994 | Yabuki | 264/345 |
| 5,294,390 | 3/1994 | Rosenberg et al. | 264/103 |
| 5,296,185 | 3/1994 | Chau et al. | 264/205 |
| 5,356,584 | 10/1994 | Bubeck et al. | 264/205 |
| 5,385,702 | 1/1995 | Mills et al. | 264/103 |
| 5,393,478 | 2/1995 | Sen et al. | 264/203 |
| 5,411,694 | 5/1995 | Alexander et al. | 264/184 |
| 5,417,915 | 5/1995 | Chau et al. | 264/344 |
| 5,429,787 | 7/1995 | Im et al. | 264/344 |

FOREIGN PATENT DOCUMENTS

| | | |
|---|---|---|
| B1393011 | 8/1988 | European Pat. Off. . |
| 9320400 | 10/1993 | WIPO . |
| 9412700 | 6/1994 | WIPO . |
| 9418015 | 8/1994 | WIPO . |

*Primary Examiner*—Morton Foelak
*Attorney, Agent, or Firm*—Ann K. Galbraith

[57] ABSTRACT

Described is a continuous process for removing polyphosphoric acid from a polybenzazole dope filament, which comprises: (a) contacting the dope filament with water or a mixture of water and polyphosphoric acid under conditions sufficient to reduce the phosphorous content of the filament to less than about 10,000 ppm by weight; and then (b) contacting the dope filament with an aqueous solution of an inorganic base under conditions sufficient to convert at least about 50 percent of the polyphosphoric acid groups present in the filament to a salt of the base and the acid. It has been discovered that contacting the dope filament with a solution of a base after washing the filament to remove most of the residual phosphorous advantageously leads to an improvement in the initial tensile strength of the filament, as well as improved retention of tensile strength and/or molecular weight (of the polybenzazole polymer) following exposure to light and/or high temperatures.

17 Claims, No Drawings

PROCESS FOR THE PREPARATION OF POLYBENZAZOLE FILAMENTS AND FIBERS

CROSS-REFERENCE TO RELATED APPLICATION

This application is a Continuation-in-Part of the application Ser. No. 08/316,266, filed Sep. 30, 1994, abandoned.

BACKGROUND OF THE INVENTION

This invention relates to processes for the preparation of polybenzazole fibers and fiber filaments.

Fibers prepared from polybenzoxazole (PBO) and polybenzothiazole (PBT) (hereinafter referred to as PBZ or polybenzazole polymers) may be prepared by first extruding a solution of polybenzazole polymer in a mineral acid (a polymer "dope") through a die or spinneret to prepare a dope filament. The dope filament is then drawn across an air gap, with or without stretching, and then coagulated in a bath comprising water or a mixture of water and a mineral acid. If multiple filaments are extruded simultaneously, they may then be combined into a multifilament fiber during or after the coagulation step. The filament or fiber is then washed in a washing bath to remove most of the mineral acid, and then dried. The physical properties of such filaments and fibers, such as tensile strength, are known to be relatively high. However, further improvement in such properties is desirable.

SUMMARY OF THE INVENTION

In one aspect, this invention is a process for removing polyphosphoric acid from a polybenzazole dope filament, which comprises:

(a) contacting the dope filament with water or a mixture of water and polyphosphoric acid under conditions sufficient to reduce the phosphorous content of the filament to less than about 10,000 ppm by weight; and then (b) contacting the dope filament with an aqueous solution of an inorganic base under conditions sufficient to convert at least about 50 percent of the polyphosphoric acid groups present in the filament to a salt of the base and the acid, wherein the process is run continuously at a line speed of at least about 50 m/minute.

It has been discovered that contacting the dope filament with a solution of a base after washing the filament to remove most of the residual phosphorous advantageously leads to an improvement in the initial tensile strength of the filament, as well as improved retention of tensile strength and/or molecular weight (of the polybenzazole polymer) following exposure to light and/or high temperatures, relative to methods wherein a base is not employed. These and other advantages of the invention are apparent from the description which follows.

DETAILED DESCRIPTION OF THE INVENTION

Polybenzazole dope filaments for use in the process of the present invention may be prepared by the extrusion of a polybenzazole dope through an extrusion die with a small diameter or a "spinneret". The polybenzazole dope comprises a solution of polybenzazole polymer in polyphosphoric acid. The term "polybenzazole" as used herein refers to polybenzoxazole ("PBO") and polybenzothiazole ("PBT").

PBO, PBT and random, sequential and block copolymers of PBO and PBT are described in references such as Wolfe et al., *Liquid Crystalline Polymer Compositions, Process and Products,* U.S. Pat. No. 4,703,103 (Oct. 27, 1987); Wolfe et al., *Liquid Crystalline Poly(2,6-Benzothiazole) Compositions, Process and Products,* U.S. Pat. No. 4,533,724 (Aug. 6, 1985); Wolfe, *Liquid Crystalline Polymer Compositions, Process and Products,* U.S. Pat. No. 4,533,693 (Aug. 6, 1985); Evers, *Thermo-oxidatively Stable Articulated p-Benzobisoxazole and p-Benzobisthiazole Polymers,* U.S. Pat. No. 4,359,567 (Nov. 16, 1982); Tsai et al., *Method for Making Heterocyclic Block Copolymer,* U.S. Pat. No. 4,578,432 (Mar. 25, 1986); 11 Ency. Poly. Sci. & Eng., *Polybenzothiazoles and Polybenzoxazoles,* 601 (J. Wiley & Sons 1988) and W. W. Adams et al., *The Materials Science and Engineering of Rigid-Rod Polymers* (Materials Research Society 1989), which are incorporated herein by reference. The polybenzazole polymer may be rigid rod, semi-rigid rod or flexible coil. It is preferably a lyotropic liquid-crystalline polymer, which forms liquid-crystalline domains in solution when its concentration exceeds a critical concentration. The intrinsic viscosity of rigid polybenzazole polymers in methanesulfonic acid at 25° C. is preferably at least about 10 dL/g, more preferably at least about 15 dL/g and most preferably at least about 20 dL/g.

The dope should contain a high enough concentration of polymer for the polymer to form an acceptable filament after extrusion and coagulation. When the polymer is lyotropic liquid-crystalline, then the concentration of polymer in the dope is preferably high enough to provide a liquid-crystalline dope. The concentration of the polymer is preferably at least about 7 weight percent, more preferably at least about 10 weight percent and most preferably at least about 14 weight percent. The maximum concentration is limited primarily by practical factors, such as polymer solubility and dope viscosity. The concentration of polymer is preferably no more than 30 weight percent, and more preferably no more than about 20 weight percent.

Suitable polybenzazole polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Gregory et al., U.S. Pat. No. 5,089,591 (Feb. 18, 1992), which are incorporated herein by reference. In summary, suitable monomers are reacted in a solution of nonoxidizing and dehydrating acid under nonoxidizing atmosphere with vigorous mixing and high shear at a temperature that is increased in step-wise or ramped fashion from no more than about 120° C. to at least about 190° C.

The dope may then be formed into a filament by extrusion through a spinneret, and drawing the filament across a gap. Suitable processes are described in the references previously incorporated and U.S. Pat. No. No. 5,034,250, which is incorporated herein by reference. The spinneret preferably contains a plurality of holes. The number of holes in the spinneret and their arrangement is not critical to the invention, but it is desirable to maximize the number of holes for economic reasons. The spinneret may contain as many as 100 or 1000 or more, and they may be arranged in circles, grids, or in any other desired arrangement. The spinneret may be constructed out of ordinary materials that will not be degraded by the dope, such as stainless steel.

Dope exiting the spinneret enters a gap between the spinneret and the coagulation bath. The gap is typically called an "air gap" although it need not contain air. The gap may contain any fluid that does not induce coagulation or react adversely with the dope, such as air, nitrogen, argon, helium or carbon dioxide. The dope is preferably drawn to a spin-draw ratio of at least about 20, highly preferably at least about 40, more preferably at least about 50 and most preferably at least about 60. The spin-draw ratio is defined in this application as the ratio between the take-up velocity of the filaments and the capillary velocity ($v_c$) of the dope in the spinneret. The shear rate at the spinneret hole wall is preferably in the range of from about 1800–6500 $s^{-1}$. The draw should be sufficient to provide a filament having the desired diameter.

In step (a) of the process of the invention, the dope filament is contacted with water or a mixture of water and polyphosphoric acid under conditions sufficient to reduce the phosphorous content of the filament to less than about 10,000 ppm by weight. This may be carried out as a single operation in one washing apparatus, or the filament may travel through several baths or washing cabinets to reduce the phosphorous content to the desired level. If a mixture of water and polyphosphoric acid is used, the concentration of polyphosphoric acid in solution should be lower than that contained in the filament in order to effectively wash the filament. Such mixtures are preferably used in the initial stages of washing, since gradual removal of polyphosphoric acid from a multifilament fiber tends to improve its physical properties.

Preferably, the filament is first "coagulated" in a coagulation bath containing water or a mixture of water and polyphosphoric acid, which removes enough of the solvent to prevent substantial stretching of the filament during any subsequent processing. The filament may then be further washed in a multi-step process. The term "coagulation" as used herein does not necessarily imply that the dope is a flowing liquid and changes into a solid phase. The dope may be at a temperature low enough so that it is essentially non-flowing before the coagulation step begins. The amount of solvent removed during the coagulation step will depend on the residence time of the filament in the coagulation bath, the temperature of the bath and the concentration of solvent therein. For example, using a 20 weight percent solution of polyphosphoric acid at a temperature of about 23° C., a residence time of about one second will remove about 70 percent of the solvent present in the filament.

The washing of the filament may be carried out by soaking the filament in water or a mixture of water and polyphosphoric acid (a "washing fluid"), but is preferably carried out in a continuous process by running the filament through a series of baths or washing cabinets. Washing cabinets typically comprise an enclosed cabinet containing one or more rolls which the filament travels around a number of times, and across, prior to exiting the cabinet. As the filament travels around the roll, it is sprayed with a washing fluid. The washing fluid is continuously collected in the bottom of the cabinet and drained therefrom.

Preferably, the surface of the filament is not allowed to dry after the coagulation step starts and before the washing step(s) are completed. It is theorized, without intending to be bound, that the wet, never-dried surface of the filament is relatively porous and provides paths to wash residual phosphorus from inside the filament. On the other hand, it is theorized that the pores close when they become dry and do not open even when they become wet again. The closed pores trap residual phosphorus inside the filament.

The temperature of the coagulation bath is preferably at least about 10° C., more preferably at least about 25° C., and is preferably no greater than about 50° C., more preferably no greater than about 40° C. The residence time of the filament in the coagulation bath is preferably at least about 1 second, and is preferably no more than about 5 seconds. The concentration of acid in the coagulation bath is preferably at least about 0.5 percent by weight, more preferably at least about 20 percent, and is preferably no greater than about 40 percent, more preferably no greater than about 25 percent. For a continuous process, it is preferable to use as low a temperature and high a solvent content as is practical, so that the solvent may be removed as slowly as possible.

The temperature of the washing fluid(s) are preferably at least about 25° C., more preferably at least about 50° C., and is preferably no greater than about 120° C., more preferably no greater than about 100° C. The washing fluid may also be applied in vapor form (steam), but is more conveniently used in liquid form. The residence time of the filament in the washing bath(s) will depend on the desired concentration of residual phosphorus in the filament, but typical residence times are in the range of from about 180 seconds to about 300 seconds. The duration of the entire washing process utilized in the first step of the process of the invention is preferably no greater than about 200 seconds, more preferably no greater than about 160 seconds.

For a continuous spinning operation, the concentration of phosphorous in the filament is preferably brought down as slowly as is practical in the coagulation and washing operations, given that for such processes, fewer steps and higher line speeds are desirable. It is believed that a slower reduction in the phosphorous concentration in the filament provides a filament which has better physical properties. It is also believed that this result is more efficiently achieved in a continuous multi-step operation, utilizing a series of baths or washing cabinets, by decreasing the concentration of acid in the washing bath as the filament proceeds down the washing line. Conveniently, the washing fluid residue collected after the last washing step may be used as the washing fluid in the next-to-last washing step, and so forth up the line, with washing fluid containing the highest acid concentration being used in the first washing step. The concentration of acid in the washing baths or cabinets is preferably at least about 0.2 percent by weight, and is preferably no greater than about 40 percent by weight.

The residual concentration of phosphorous in the filament after step (a) of the process is preferably less than about 8,000 ppm, more preferably less than about 6,000 ppm, and most preferably less than about 4,000 ppm. The residual phosphorus content of a substantially dry filament may be measured using X-ray fluorescence techniques described in E. P. Bertin, *Principles and Practice of X-Ray Spectrometric Analysis—Second Ed.* (Plenum Press 1984), which is incorporated herein by reference. Suitable equipment is commercially available under the trade name KEVEX 770 XRF and from Philips Electronic Instruments.

The filament utilized in the process of the invention may be combined into a multifilament fiber at any point during the process of the invention. Preferably, however, the filaments are combined just prior to, or during, coagulation. While the term "filament" is used throughout this application to describe the process of the invention, the process of the invention may of course also be carried out on a filament contained in a multifilament fiber, utilizing the same process parameters as described herein for use with a single filament.

The filament is preferably under tension during at least part of the washing process. More preferably, tension is also applied throughout the coagulation and washing process, particularly when the fluid temperature is very high. The tension is preferably sufficient to prevent the filament from shrinking or relaxing.

In the second step of the process of the invention, the dope filament is contacted with an aqueous solution of an inorganic base under conditions sufficient to convert at least about 50 percent of the acid groups present in the filament to the corresponding salt form (hereafter "neutralization step"). This step may likewise be carried out in a single operation, or the filament may travel through several baths or washing cabinets to reduce the phosphorous content to the desired level. Preferably, however, this step is carried out in a single washing cabinet as described above. Examples of suitable water-soluble bases include sodium hydroxide, ammonium hydroxide, sodium carbonate, and sodium bicarbonate. The percentage of acid groups which have been converted may be followed by any suitable technique, such as nuclear magnetic resonance spectroscopy (NMR) or Fourier transform infrared spectroscopy (FTIR).

The concentration of base in the solution is preferably at least about 0.2 weight percent, more preferably at least about 0.4 weight percent, and is preferably no greater than about 1.2 weight percent, more preferably no greater than about 0.8 weight percent. The duration of this second step will depend on the concentration of the base, with longer residence times required for lower concentrations, but is preferably no greater than about 120 seconds, more preferably no greater than about 60 seconds. Preferably at least about 50 percent of the acid groups remaining after step (a) are converted to their salt form, more preferably at least about 75 percent, and most preferably at least about 95 percent are so converted. The preferred pH of the base solution used in the neutralization step will depend on the duration of the step, with a higher pH preferred with a shorter duration, but is preferably in the range of from about 10 to about 14, more preferably in the range of from about 11 to about 12.

Since residual base in the fiber tends to degrade the properties of the fiber, particularly if the fiber is heat-treated after the neutralization step, the concentration of base and residence times are preferably selected to achieve a stoichiometric ratio of base:acid groups in the fiber of at least about 0.5:1.0, more preferably at least about 0.75:1.00, and is preferably no greater than about 1.5:1.0, more preferably no greater than about 1.25:1.0, but is most preferably about 1:1. The stoichiometry of the process can be determined by a suitable method, such as by measuring the ratio of phosphorous to the conjugate acid of the inorganic base in the fiber after the neutralization step. For example, if sodium hydroxide is used, the ratio of phosphorous:sodium in the fiber may be measured by a suitable technique such as Neutron Activation Analysis.

The process of the present invention is preferably run in a continuous fashion with a line speed of at least about 50 m/min. The line speed is highly preferably at least about 200 m/min., more preferably at least about 400 m/min. and most preferably at least about 600 m/min.

Following the second step of the process, if any residual base is present in the fiber, the fiber is preferably washed further with water for a residence time of at least about 1 second to remove most of the residual base. The particular washing conditions will depend on the amount of residual base present, with longer residence times required to remove greater amounts of base. Thereafter, the filament may be dried, heat-treated, and/or wound on rolls as desired, as described, for example, in U.S. Pat. No. 5,296,185, which is hereby incorporated by reference. Multifilament fibers containing PBZ polymers may be used in ropes, cables, fiber-reinforced composites and cut-resistant clothing.

ILLUSTRATIVE EMBODIMENTS

The following examples are given to illustrate the invention and should not be interpreted as limiting it in any way. Unless stated otherwise, all parts and percentages are given by weight.

EXAMPLES 1–10

A 14 weight percent solution of polybenzoxazole ("PBO") in polyphosphoric acid ("PPA"; available from Eastman Kodak Company) with intrinsic viscosity between 30–34 (measured in methanesulfonic acid at 23° C.) is prepared. PBO filaments are extruded at a temperature between 165° C. out of a 180 micron spinneret with 42 holes into a coagulation bath, and combined into a multifilament fiber. A glass shroud is placed in the air gap, between the spinneret face and the surface of the coagulation bath liquid in order to minimize air currents in the air gap. The filaments are produced by using a shear rate at the spinneret hole wall of about 3500 $s^{-1}$. The spin-draw ratio utilized is 44, with a fiber take-up speed of 200 m/min. The resulting filaments have a denier of 1.5 denier per filament and a diameter of 11.5 microns.

The fibers are coagulated in a bath of water and polyphosphoric acid having an acid content of about 20 percent by weight. The residence time in the coagulation stage is about 0.5 seconds and the temperature is about 10° C. The fibers are then washed off-line with water (as comparative examples), or in a three-step process using water, a 0.05 weight percent aqueous solution of sodium hydroxide, and water, using a washing temperature of about 23° C.

After washing, the fiber is dried under nitrogen at room temperature (23° C.) for an additional 48 hours. A portion of the samples are heat-set through a nitrogen-purged tube furnace with a residence time of 2 seconds at 600° C. A constant tension of about 3.5 g/denier is maintained on the fiber during heat setting.

Residual phosphorus is measured using X-ray fluorescence on a Philips PW1404/DY685 sequential spectrometer with a scandium X-ray tubes and fiber samples which have been pressed into a pellet for analysis. The tensile strength retention and intrinsic viscosity of each fiber is then measured, both before and after heat-treatment. The retention of tensile strength (TSR), defined as (photo-aged tensile strength/initial tensile strength)×100%, is used for expressing the retention of tensile strength after photo-aging, although separate samples are used for each measurement. Photo-aging is carried out in an Atlas Model Ci65A weatherometer with a xenon lamp and borosilicate filter. Fiber strands are mounted on sample holders and photo-exposed in the weatherometer. The exposure is 765 watt/$m_2$ with a 300 to 800 nm wave length for a total of 100 hrs.

The procedure used for measurement of tensile strength is as follows: Tensile properties were measured in accordance with ASTM D-2101, on an Instron 4201 universal testing machine. A 10 lb. load cell was used with a crosshead speed of 1.0 inches/min., and a gauge length of 10.0 inches. Tensile data is obtained on the 42-filament fibers with a twist factor of 6–7. The intrinsic viscosity (IV) of the fiber samples was measured by dissolving them in methanesulfonic acid, and measuring the intrinsic viscosity at 23° C.

Each number reported in the table is an average over ten samples, and different fiber samples are used to measure the as-spun and heat-treated properties of the fiber. All of the fiber samples for which data is shown in Table 1 are taken from the same roll of fiber, at sequential locations along the roll. That is, the samples used for Comparative Example 1 were taken from the portion of the roll adjacent to the samples used in Example 2, and so forth. The results are given in Table 1.

TABLE 1

| Example No. | Washing Process* | P (ppm) | TSR A-S | TSR H-T | IV A-S | IV H-T |
|---|---|---|---|---|---|---|
| 1 (Comp.) | Water (20) | 5000 | 71 | 83 | 24.3 | 19.3 |
| 2 | Water (5) NaOH (5) Water (10) | 4200 | 81 | 86 | 26.3 | 24.1 |
| 3 (Comp.) | Water (20) | 5100 | 73 | 84 | 23.2 | 18.5 |
| 4 | Water (5) NaOH (5) Water (10) | 4500 | 83 | 88 | 25.4 | 24.1 |
| 5 (Comp.) | Water (20) | 4400 | 71 | 84 | 23.5 | 19.4 |
| 6 | Water (5) NaOH (5) Water (10) | 4500 | 85 | 90 | 25.6 | 24.5 |
| 7 (Comp.) | Water (20) | 4400 | 72 | 82 | 23.3 | 19.1 |
| 8 | Water (5) NaOH (5) Water (10) | 4800 | 81 | 87 | 25.5 | 23.5 |
| 9 (Comp.) | Water (20) | 5000 | 76 | 84 | 23.0 | 19.4 |
| 10 | Water (5) NaOH (5) Water (10) | 4000 | 82 | 89 | 25.8 | 24.0 |

P-Residual phosphorous content, parts per million by weight
TSR-Tensile strength retention (% of tensile strength retained after Weatherometer treatment)
IV-Intrinsic viscosity
A-S-as-spun fiber; H-T-heat-treated fiber
*-shown in the table as the residence time in the washing bath, in minutes
(Comp.)-Comparative Example-not an example of the invention The data shows that the tensile strength retention of the fibers is improved when the fibers are neutralized using sodium hydroxide.

EXAMPLES 11–13

Using the method described in Examples 1–10, fiber samples comprised of filaments with a denier of 1.5 denier per filament and a diameter of 11.5 microns are prepared, coagulated in water for 1 second, washed in water for 10 minutes, and contacted with a 0.1N aqueous solution of a base for 10 minutes. In Example 12, the samples are subsequently washed with water at room temperature for 24 hours. The tensile strength of the samples are measured, and heat-treatment is carried out, as described in Examples 1–10. The residual sodium and phosphorous content of the fiber is also shown (Na), as measured by Neutron Activation Analysis. The data is shown in Tables 2a and 2b.

TABLE 2a

| Example | Base | 2nd Wash | P(ppm) | Na (ppm) |
|---|---|---|---|---|
| 11 | NaOH | No | 5000 | 9000 |
| 12 | NaOH | Yes | 2400 | 9400 |
| 13 | $Na_2CO_3$ | No | 5300 | 14000 |

TABLE 2b

| Example | TS (A-S) | TM (A-S) | TS (H-T) | T-M (H-T) | IV (A-S) |
|---|---|---|---|---|---|
| 11 | 790 | 28.5 | 583 | 39.3 | 34 |
| 12 | 810 | 29.6 | 685 | 42.4 | 37 |
| 13 | 780 | 28 | 504 | 43 | 35 |

TS (A-S)-tensile strength, as spun, ksi (1000 psi = 1 ksi)
TM (A-S)-tensile modulus, as spun, msi ($1 \times 10^6$ psi = 1 msi)
TS (H-S)-tensile strength, heat-treated, ksi
TM (H-S)-tensile modulus, heat-treated, msi
IV (A-S)-intrinsic viscosity, as spun

EXAMPLES 14–20

Using the method described in Examples 1–10 (with the exception that the filaments are spun through a spinneret having 166 holes and are coagulated for 1 second in a bath containing 20 percent by weight PPA and the filaments are spun at a rate of 100 m/min.), fiber samples comprised of filaments having a denier of 1.5 denier per filament and a diameter of 11.5 microns are prepared, coagulated, and washed for a period of time sufficient to give the residual levels of phosphorous shown in Table 3. The samples are then contacted with a 0.1N aqueous solution of a base for 5 minutes. Steam-jet heat-treatment is performed at about 545° C. at a line speed of 40 m/min. and a residence time of 1.5 seconds, applying a tension of about 5.5 g/denier. Examples 14–16 are comparative examples wherein the fiber is not contacted with a base. The residual sodium content of the fiber is also shown (Na), as measured by Neutron Activation Analysis. The tensile strength of the fibers is measured as described in Examples 1–10. The data is shown in Table 3.

TABLE 3

| Example | P (ppm) | TS (A-S) | TM (A-S) | IV (A-S) | TS (H-T) | TM (H-T) | IV (H-T) |
|---|---|---|---|---|---|---|---|
| 14* | 2900 | 35.8 | 1568 | 25 | 33.13 | 1652 | 19.4 |
| 15* | 2900 | 35.8 | 1568 | | 35.0 | 1916 | |
| 16* | 3300 | 37.3 | 1594 | 24.4 | 35.5 | 1953 | 19.1 |
| 17 | 2950 | 42.3 | 1547 | 27.2 | 41.3 | 1954 | 23.8 |
| 18 | 3000 | 42.2 | 1531 | 27.2 | 41.4 | 1655 | 24.9 |
| 19 | 3125 | 40.9 | 1559 | 28.1 | 41.3 | 1942 | 24.2 |
| 20 | 3125 | 41.5 | 1583 | 27.4 | 41.8 | 1908 | 23.8 |

*comparative example-not an example of the invention

What is claimed is:

1. A process for removing polyphosphoric acid from a polybenzazole dope filament, which comprises:

(a) contacting the dope filament with water or a mixture of water and polyphosphoric acid under conditions sufficient to reduce the phosphorous content of the filament to less than about 10,000 ppm by weight; and then (b) contacting the dope filament with an aqueous solution of an inorganic base under conditions sufficient to convert at least about 50 percent of the polyphosphoric acid groups present in the filament to a salt of the base and the acid, wherein the process is run continuously at a line speed of at least about 50 m/minute.

2. The process of claim 1 wherein step (a) comprises the sequential steps of (1) coagulating the filament in a coagulation bath and (2) washing the filament in at least one separate washing bath.

3. The process of claim 2 wherein the residence time of the filament in the coagulation bath is at least about 1 second and no more than about 5 seconds.

4. The process of claim 2 wherein the cumulative residence time of the filament in the washing bath(s) is no longer than about 200 seconds.

5. The process of claim 1 wherein the residual concentration of phosphorous in the filament after step (a) is less than about 8,000 ppm.

6. The process of claim 5 wherein the residual concentration of phosphorous in the filament after step (a) is less than about 6,000 ppm by weight.

7. The process of claim 6 wherein the residual concentration of phosphorous in the filament after step (a) is less than about 4,000 ppm by weight.

8. The process of claim 8 wherein at least about 75 percent of the acid groups remaining after step (a) are converted to their salt form in step (b).

9. The process of claim 9 wherein at least about 95 percent of the acid groups remaining after step (a) are converted to their salt form in step (b).

10. The process of claim 1 wherein the stoichiometric ratio of base:acid groups in the fiber in step (b) is at least about 0.5:1.0.

11. The process of claim 1 wherein the stoichiometric ratio of base:acid groups in the fiber in step (b) is at least about 0.75:1.00.

12. The process of claim 1 wherein the stoichiometric ratio of base:acid groups in the fiber in step (b) is no greater than about 1.5:1.0.

13. The process of claim 1 wherein the stoichiometric ratio of base:acid groups in the fiber in step (b) is less than about 1.25:1.0.

14. The process of claim 1 wherein the stoichiometric ratio of base:acid groups in the fiber in step (b) is about 1:1.

15. The process of claim 1 characterized in that the process is run continuously at a line speed of at least about 200 m/min.

16. The process of claim 1 wherein the fiber is washed with water for a residence time of at least about 1 second following step (b).

17. A process for removing polyphosphoric acid from a polybenzazole dope filament, which comprises:

(a) contacting the dope filament with water or a mixture of water and polyphosphoric acid under conditions sufficient to reduce the phosphorous content of the filament to less than about 10,000 ppm; by weight and then (b) contacting the dope filament with an aqueous solution of an inorganic base under conditions sufficient to convert at least about 50 percent of the polyphosphoric acid groups present in the filament to a salt of the base and the acid, wherein the stoichiometric ratio of base:acid groups in the fiber in step (b) is less than about 1.25:1.0 and the process is run continuously at a line speed of at least about 200 m/min.

* * * * *